US010036383B2

(12) United States Patent
Stockner et al.

(10) Patent No.: US 10,036,383 B2
(45) Date of Patent: Jul. 31, 2018

(54) PUMP PISTON HAVING VARIABLE DIAMETER

(71) Applicant: Caterpillar Inc., Peoria, IL (US)

(72) Inventors: Alan Ray Stockner, Metamora, IL (US); Sana Mahmood, Peoria, IL (US); Joshua Steffen, El Paso, IL (US); Dana Ray Coldren, Secor, IL (US)

(73) Assignee: Caterpillar Inc., Deerfield, IL (US)

( * ) Notice: Subject to any disclaimer, the term of this patent is extended or adjusted under 35 U.S.C. 154(b) by 591 days.

(21) Appl. No.: 14/681,006

(22) Filed: Apr. 7, 2015

(65) Prior Publication Data

US 2016/0298622 A1 Oct. 13, 2016

(51) Int. Cl.

| | |
|---|---|
| ***F04B 53/14*** | (2006.01) |
| ***F04B 53/00*** | (2006.01) |
| *F04B 15/08* | (2006.01) |

(52) U.S. Cl.

CPC ..... *F04B 53/14* (2013.01); *F04B 53/008* (2013.01); *F04B 2015/081* (2013.01)

(58) Field of Classification Search

CPC ..... F04B 53/14; F04B 53/008; F04B 1/0408; F02M 59/442; F02M 59/44; F02M 59/025

See application file for complete search history.

(56) References Cited

U.S. PATENT DOCUMENTS

| | | | | |
|---|---|---|---|---|
| 1,054,345 | A | 2/1913 | Piston | |
| 2,855,859 | A | 10/1958 | Petzold | |
| 4,813,342 | A | 3/1989 | Schneider et al. | |
| 5,188,519 | A | 2/1993 | Spulgis | |
| 2013/0167797 | A1 * | 7/2013 | Svrcek | F16J 1/09 123/193.4 |

FOREIGN PATENT DOCUMENTS

| | | | | |
|---|---|---|---|---|
| DE | 102009001440 | A1 * | 9/2010 | F02M 59/442 |
| EP | 1 314 886 | A2 | 5/2003 | |
| FR | 2 667 116 | A1 | 3/1992 | |

* cited by examiner

*Primary Examiner* — F. Daniel Lopez
*Assistant Examiner* — Abiy Teka
(74) *Attorney, Agent, or Firm* — Finnegan, Henderson, Farabow, Garrett & Dunner, LLP; John Wappel

(57) ABSTRACT

A pump piston is disclosed. The pump piston may include a body having an actuating end, a pressurizing end opposite the actuating end, and an outer diameter that is greater at the pressurizing end than at the actuating end, wherein the outer diameter varies between the pressurizing end and the actuating end without increasing to form an outer diameter profile.

18 Claims, 4 Drawing Sheets

PUMP PISTON HAVING VARIABLE DIAMETER

TECHNICAL FIELD

The present disclosure relates generally to a pump piston and, more particularly, to a piston having a variable diameter.

BACKGROUND

Gaseous fuel powered engines are common in many applications. For example, the engine of a locomotive can be powered by natural gas (or another gaseous fuel) alone, or by a mixture of natural gas and diesel fuel. Natural gas may be more abundant and, therefore, less expensive than diesel fuel. In addition, natural gas may burn cleaner in some applications.

Natural gas, when used in a mobile application, may be stored in a liquid state onboard the associated machine. This may require the natural gas to be stored at cold temperatures, typically about −100 to −162° C. The liquefied natural gas (LNG) may then be drawn from the tank by gravity and/or by a boost pump and directed to a high-pressure pump. The high-pressure pump further increases a pressure of the fuel and directs the fuel to the machine's engine. In some applications, the liquid fuel is gasified prior to injection into the engine and/or mixed with diesel fuel (or another fuel) before combustion.

One problem associated with high-pressure pumps involves reducing leakage of fuel past pistons of the pump. Although generally tight tolerances between the pistons and associated barrels can be maintained to reduce leakage, such tolerances can also increase friction between the pistons and barrels. This friction requires more energy to drive the pump. Pumps can also have seals between the pistons and barrels to help reduce leakage. The seals can wear over time, thereby reducing the lifespan of the pump.

One attempt to improve sealing around. a piston of a pump is disclosed in U.S. Pat. No. 4,813,342 (the '342 patent) that issued to Schneider et al. on Mar. 21, 1959. in particular, the '342 patent discloses a piston for a reciprocating pump that pressurizes cryogenic fluids. The piston has a core attached to a push rod of the pump. The core includes a shaft that has flanged ends and is surrounded by a sleeve between the flanged ends. Between the sleeve and each of the flanged ends of the shaft are seal rings and expanding members that have higher coefficients of thermal expansion than the sleeve. When the piston is cooled and the core shrinks axially, the flanged ends of the shaft are drawn into the expanding members, which push outwardly on the seal rings to create a seal between the piston and a barrel cylinder of the pump.

While the piston of the '342 patent may have reduced leakage, it may still exhibit a significant amount of friction. Further, the expanding members of the core may increasingly push the associated rings against the cylinder, which increases wear of the rings.

The disclosed piston is directed to overcoming one or more of the problems set forth above and/or other problems of the prior art.

SUMMARY

In one aspect, the present disclosure is directed to a pump piston. The pump piston may include a body having an actuating end, a pressurizing end opposite the actuating end, and an outer diameter that is greater at the pressurizing end than at the actuating end, wherein the outer diameter varies between the pressurizing end and the actuating end without increasing to form an outer diameter profile.

In another aspect, the present disclosure is directed to a pump piston. The pump piston may include a body having an actuating end connectable to an actuator, and a pressurizing end opposite the actuating end. The pressurizing end may include an annular wall having a fixed end attached to the body, a free end opposite the fixed end, and a cavity having an opening disposed at the free end of the annular wall. The pressurizing end may further include a head attached to the body and disposed within the cavity, wherein the head occupies a majority of the cavity.

In yet another aspect, the present disclosure is directed to a pump. The pump may include at least one pumping mechanism configured to be fluidly connected to a source of cryogenic fluid. The at least one pumping mechanism may include a barrel configured to receive and discharge cryogenic fluid, and a piston configured to be reciprocally driven within the barrel to pressurize the cryogenic fluid. The piston may include an actuating end connectable to an actuator, and a pressurizing end opposite the actuating end. The pressurizing end may include an annular wall having a fixed end attached to the body, a free end opposite the fixed end, and an inner diameter. The pressurizing end may further include a cavity having an opening disposed at the free end of the annular wall, and a head attached to the body and disposed within the cavity, wherein the head occupies a majority of the cavity. The body may further include an outer diameter that varies along an axial length of the body between the pressurizing end and the actuating end, wherein the outer diameter is greater at the pressurizing end than at the actuating end.

DETAILED DESCRIPTION

Figure 1:
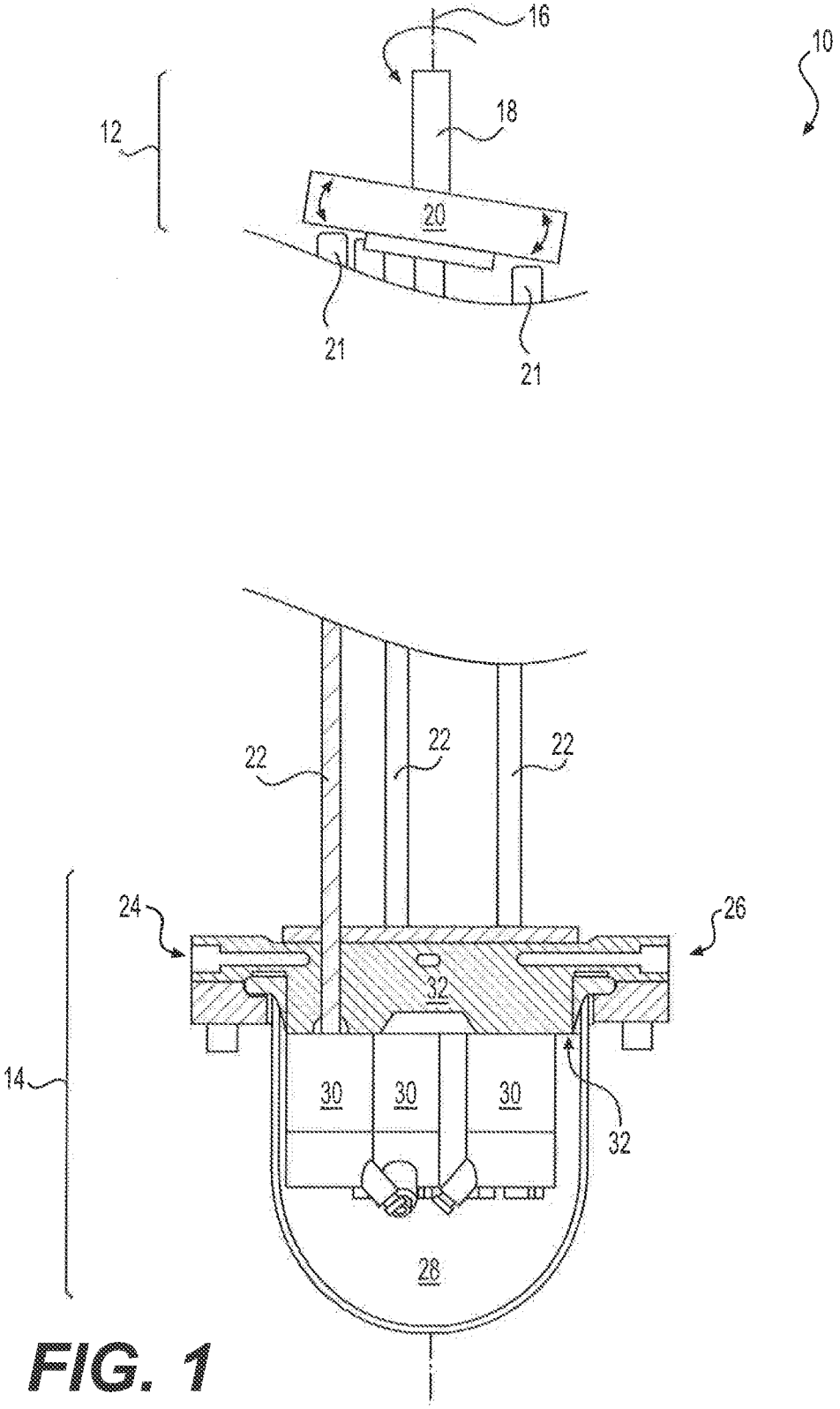
FIG. 1 is a schematic illustration of an exemplary disclosed pump.

FIG. 1 illustrates a pump 10 that may be used to supply a pressurized fuel, such as a cryogenic fluid (e.g., liquefied natural gas (LNG), helium, hydrogen, nitrogen, oxygen, etc.) to a consumer, such as a gaseous fuel-powered engine. It is contemplated, however, that pump 10 may supply other gaseous fuel consumers. Pump 10 may be mechanically driven by an external source of power (e.g., an engine or a motor) at an input end 12 to generate a high-pressure fluid discharge at an output end 14. In this example, input end 12 and output end 14 are aligned along a common axis 16 and connected end-to-end.

Input end 12 may include a driveshaft 18 rotatably supported within a housing (not shown), and connected at an internal end to a load plate 20. Load plate 20 may be oriented at an oblique angle relative to axis 16, such that an input rotation of driveshaft 18 may be converted into a corresponding undulating motion of load plate 20. A plurality of tappets 21 may slide along a lower face of load plate 20, and a push rod 22 may be associated with each tappet 21. In this way, the undulating motion of load plate 20 may be transferred through the tappets 21 to push rods 22 and used to pressurize the fluid passing through pump 10. A resilient member (not shown), for example a coil spring, may be associated with each push rod 22 and configured to bias the associated tappet 21 into engagement with load plate 20. Each push rod 22 may be a single-piece component or, alternatively, comprised of multiple pieces, as desired. Many different shaft/load plate configurations may be possible, and the oblique angle of load plate 20 may be fixed or variable, as desired. Other configurations of input end 12 may be possible.

Output end 14 may be in fluid communication with a cryogenic fluid source via an inlet 24 and an outlet 26. For example, LNG may be supplied to output end 14 from an associated storage tank storing LNG at temperatures of, e.g., about −100 to −162° C. This continuous supply of cold fluid to output end 14 may cause output end 14 to be significantly cooler than input end 12. Cryogenic fluid may be directed through inlet 24 to a reservoir 28 in output end 14.

Output end 14 may include one or more pumping mechanisms 30 fluidly connected to reservoir 28 to draw cryogenic fluid from reservoir 28. In the exemplary embodiment, output end 14 has five pumping mechanisms 30, but it is understood that there may be any number of pumping mechanisms 30. Pumping mechanisms 30 may be mounted to a manifold 32 disposed in output end 14 and may extend into reservoir 28. Push rods 22 may pass through manifold 32 and connect with each pumping mechanism 30.

Figure 2:
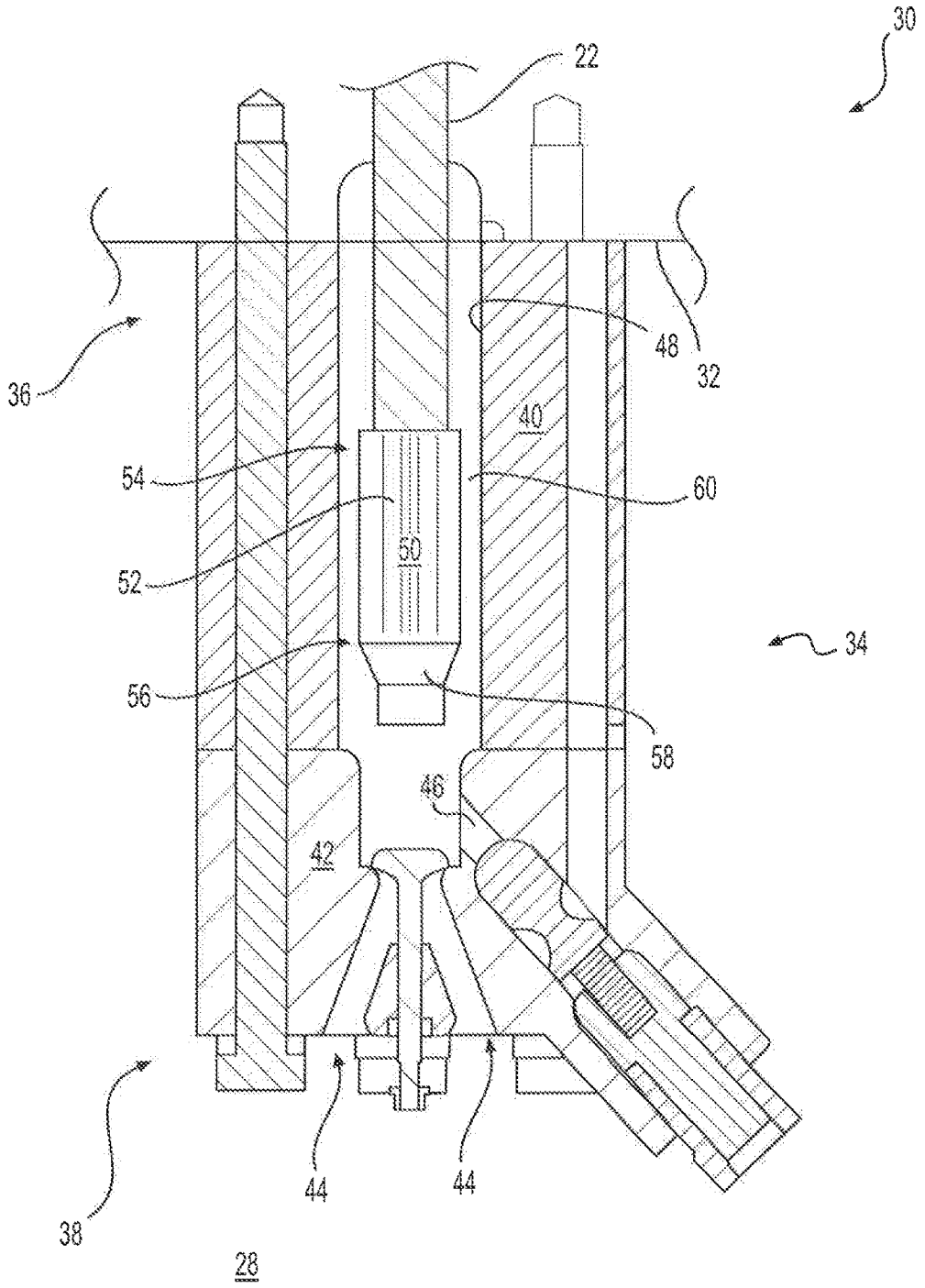
FIG. 2 is cross sectional illustrations of an exemplary disclosed pumping mechanism of the pump of FIG. 1.

As shown in FIG. 2, each pumping mechanism 30 may include a barrel assembly 34 including a proximal end 36 and a distal end 38 opposite proximal end 36. The terms "proximal" and "distal" are used herein to refer to the relative positions of the components of exemplary barrel assembly 34. When used herein, "proximal" refers to a position relatively closer to manifold 32. In contrast, "distal" refers to a position relatively further away from manifold 32.

Barrel assembly 34 may include a generally hollow barrel 40 located at proximal end 36 and a head 42 located at distal end 38. Barrel 40 may be formed from a material that can withstand temperature changes (e.g., from ambient to about −165° C.) without operation disruption. This material may resist cracking or other mechanical failures, and may have a low coefficient of thermal expansion (COE). For example, the material of barrel 40 may be stainless steel or a ceramic that is suitable for operation at such low temperatures. However, it is understood that barrel 40 may be formed of another material, if desired.

Head 42 may be attached to barrel 40 to close off barrel 40. Alternatively, barrel assembly 34, including barrel 40 and head 42, may be formed integrally as a single component. Head 42 may include at least one inlet 44 in fluid communication with reservoir 28 for drawing cryogenic fluid from reservoir 28 into barrel assembly 34. Head 42 may also include at least one outlet 46 in fluid communication with outlet 26 (referring to FIG. 1)

A piston bore 48 may extend through barrel 40 and be configured to slidably receive a piston 50. A proximal end of piston bore 48 may align with a corresponding push rod 22, such that push rod 22 may serve as an actuator to push piston 50 through piston bore 48. Alternatively, piston 50 may be permanently connected to push rod 22, and the undulation of load plate 20 may cause push rod 22 to push and pull piston 50 through piston bore 48. During the movement of piston 50, high pressures may be generated within piston bore 48 and head 42.

Piston 50 may include a body 52 that is configured to be reciprocally driven within piston bore 48 to pressurize fluid. Body 52 may have an actuating end 54 and a pressurizing end 56. Actuating end 54 may abut the end of corresponding push rod 22, and may be proximally positioned in piston bore 48 with respect to pressurizing end 56. Pressurizing end 56 may be opposite actuating end and configured to pressurize fluid against head 42 of barrel assembly 34. In the example of FIG. 2, pressurizing end 56 includes a head 58 connected to body 52 that is configured to extend into head 42 of barrel assembly 34 to displace additional volume during pressurizing strokes of pump 10.

Piston 50 may slide between a Bottom-Dead-Center position (BDC) and a Top-Dead-Center (TDC) position within piston bore 48 of barrel 40. While piston 50 reciprocates between BDC and TDC, distal end 38 of barrel assembly 34 may eventually reach an operating pressure $P_1$ and an operating temperature $T_1$. Operating pressure $P_1$ may force fluid to leak past piston 50 through an annular gap 60 between body 52 and piston bore 48 into proximal end 36 of barrel assembly 34. Fluid pressure in gap 60 may vary (e.g., decrease) from about operating pressure $P_1$ near pressurizing end 56 to a lower pressure $P_2$ near actuating end 54. As fluid travels through gap 60 from pressurizing end 56 to actuating end 54, a temperature of the fluid in gap 60 may increase from about operating temperature $T_1$ to a higher temperature $T_2$. Thus, an axial pressure differential and an axial temperature differential may exist between pressurizing end 56 and actuating end 54 of body 52. Further, since pumping mechanism 30 extends into reservoir 28 that contains a cryogenic. fluid, barrel 40 may be at a lower temperature. $T_B$ than $T_1$, thereby creating a radial temperature differential between barrel 40 and piston 50.

Cumulative effects of these pressure and temperature differentials may result in various amounts of deflection (e.g., expansion and/or contraction) of piston bore 48 and body 52. For example, fluid pressure in distal end 38 of barrel assembly 34 may reach high enough values (e.g., about 42 MPa) during pressurizing strokes to generate axial forces on piston 50, causing body 52 to expand radially outward toward a wall of piston bore 48 and reduce the width of gap 60 between them. It is understood, however, that higher or lower pressures may be achieved during operation of pump 10. Further, the temperature differential between barrel 40 and piston 50 may cause body 52 to contract less than barrel 40, moving body 52 even closer to the wall of piston bore 48 and further reducing gap 60. The temperature differential between pressurizing end 56 and actuating end 54 may further reduce contraction of body 52, and thus gap 60, near actuating end 54.

However, fluid that has leaked into gap 60 at an initial pressure of $P_1$ may produce radial forces on piston 50 and piston bore 48 that act to increase the width of gap 60. These radial threes may cause an outward expansion of barrel 40, while opposing the outward expansion of body 52 along piston 50. As the pressure within gap 60 decreases from pressurizing end 56 to actuating end 54, the radial forces may also decrease. This change in pressure and force along body 52 may increase the width of gap 60 more near pressurizing end 56 and less near actuating end 54. The net effects of the temperature and pressure differentials may cause gap 60 to be widest near pressurizing end 56 and narrowest near actuating end 54. These effects may also cause gap 60 to be uneven (i.e., non-uniform) along the axial length of piston 50, which may result in high friction where gap 60 is too narrow and/or leakage where gap 60 is too wide.

To reduce this friction and leakage, piston 50 may have an outer profile that is shaped to accommodate the expansion of piston bore 48 and body 52, while achieving a desired clearance in gap 60 (referring to FIG. 2) during operation of pump 10. For example, piston 50 may have an outer diameter (OD) that varies along an axial length $L_1$ of body 52, to form an OD profile 62 that is greater at pressurizing end 56 than at actuating end 54. Since the pressure in piston bore 48 may be highest and the temperature of body 52 may be lowest near actuating end 56, the net expansion of piston bore 48 and body 52 may increase gap 60 to a widest point near actuating end 56. Thus, OD profile 62 may be largest near pressurizing end 56 in order to offset this increase of gap 60. Conversely, pressure in piston bore 48 may be lowest and the temperature of body 52 may be highest near actuating end 54, thereby decreasing gap 60 to a narrowest point near actuating end 54. Therefore, OD profile 62 may be narrowest near actuating end 54 to offset this decrease in gap 60. For example, in one embodiment, OD profile 62 may be about 32 mm near pressurizing end and may be about 0.003-0.1% (e.g., about 0.047%) larger at pressurizing end 56 than at actuating end 54. That is, OD profile 62 may be about 15 microns greater at pressurizing end 56 than at actuating end 54. It is understood, however, that OD profile 62 may vary by a greater or smaller amount, and that for any desired difference between pressurizing and actuating ends 56 and 54, the percent difference of OD profile 62 from one end to the other may be determined by the length $L_1$ of body 52.

As the fluid in gap 60 travels from pressurizing end 56 toward actuating end 54, the volume of gap 60 may allow the fluid to expand and the pressure of the fluid to decrease. The pressure of the fluid may decrease more rapidly between actuating end 54 and an intermediate point 64 than between pressurizing end 56 intermediate point 64 because the net expansion, and hence the width of gap 60, changes less from pressurizing end 56 to intermediate point 64 than from intermediate point 64 to actuating end 54 due to the mechanical properties of the material that firms piston bore 48 and body 52. Intermediate point 64 may be a virtual reference point along the length L of body 52 that divides OD profile 62 into portions having different attributes (e.g., slope, shape of curve, average change per unit length, width of gap 60 between barrel 40, net expansion of body 52 and barrel 40, etc.), Further the temperature of body 52 may decrease more rapidly between intermediate point 64 and actuating end 54 due to the rapid pressure decrease between intermediate point 64 and actuating end 54. That is, the fluid may expand at constant enthalpy as it moves through gap 60 from pressurizing end 56 to actuating end 54, thereby resulting in a temperature rise near actuating end and a temperature differential between pressurizing end 56 and actuating end 54. Accordingly, these rates of change of pressure and temperature may cause the width of gap 60 to change at a first lower rate between pressurizing end 56 and intermediate point 64, and at a second higher rate between intermediate point 64 and actuating end 54. To accommodate these variations in gap 60, OD profile 62 may decrease at a first lower rate from pressurizing end 56 to intermediate point 64, and at a second higher rate from intermediate point 64 to actuating end 54.

Figure 3:
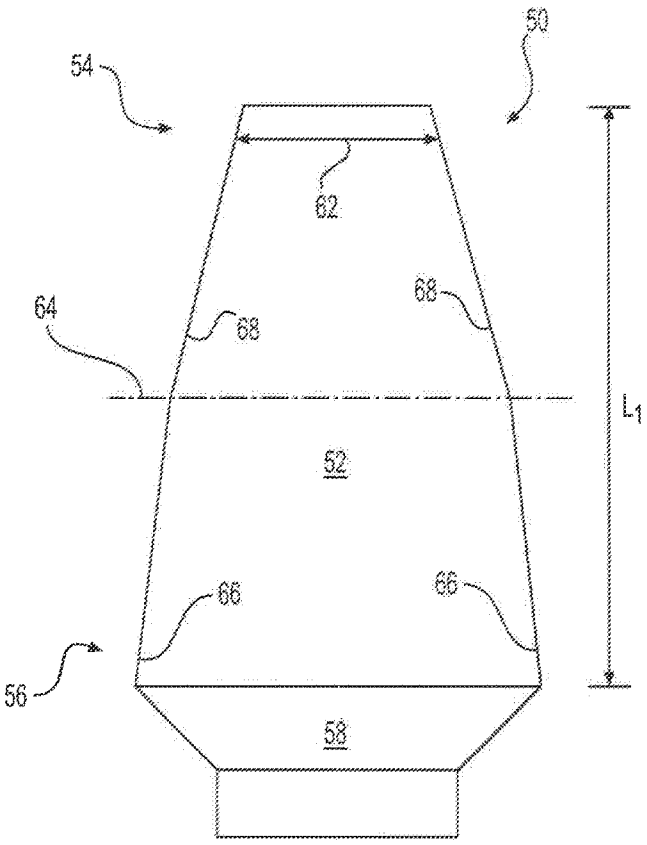

For example, as shown in FIG. 3, intermediate point 64 may be between about 25% and 75% (e.g., about 50%) of the distance from pressurizing end 56 to actuating end 54. It is understood however, that intermediate point may be closer to or farther from pressurizing end 56 if desired. OD profile 62 may, for example, be at least partially tapered between pressurizing end 56 and actuating end 540 in one embodiment, OD profile 62 may have, for example, a first taper 66 between pressurizing end 56 and intermediate point 64, and a second taper 68 between intermediate point 64 and actuating end 54. First taper 66 may reduce OD profile 62 at a first rate from pressurizing end 56 toward intermediate point 64. For example, OD profile 62 may be about 32 mm near pressurizing end 56, and first taper 66 may reduce OD profile 62 by about 5-8 microns, or by about 0.016-0.025%, from pressurizing end 56 to intermediate point 64. Second taper 68 may reduce OD profile 62 by a second greater rate of about 7-10 microns, or by about 0.022-0.031%, from intermediate point 64 to actuating end 54 along the length $L_1$ of body 52. It is understood, however, that OD profile 62 may vary by greater or lesser rates between pressurizing end 56 and actuating end 54, if desired. In this way, tapers 66 and 68 may sufficiently offset subtle variations (e.g., increase and/or decreases) in the width of gap 60 and be less costly to manufacture than more complex profiles. In other embodiments, OD profile 62 may have additional tapers or a curved profile to accommodate more complex variations in the width of gap 60.

In other embodiments, OD profile 62 may vary non-linearly between pressurizing end 56 and actuating end 54 to more accurately accommodate complex variations in the width of gap 60 (referring to FIG. 2). For example, OD profile 62 may be at least partially curved, and vary intermittently or continually depending on the net expansion of body 52 and piston bore 48, and may include one or more distinct curves and/or tapers along the length $L_1$ of body 52. For example, OD profile 62 may have concave and convex portions between pressurizing end 56 and actuating end 54. It is understood that OD profile 62 may embody other types of curves, if desired. For example, portions of OD profile 62 may be generally exponential, logarithmic, quadratic, etc., or specially curved to achieve a desired change in flexibility or a desired offset of gap 60. For example, the outer diameter of body 52 may be greater at pressurizing end 56 than at actuating end 54 and may vary between pressurizing end 56 and actuating end 54 without increasing, according to a desired curved or other shaped profile, to form OD profile 62. Such a curved profile may be formed in body 52 by a manufacturing or finishing process, such as by casting, forging, material deposition, machining, grinding, etc.

Because the net expansion of piston bore 48 and body 52 varies with the pressure in piston bore 48, the effects of expansion may be greatest during pressurizing strokes of pump 10 and least during return strokes. And since the net expansion near pressurizing end 56 may be mostly attributed to the pressure in piston bore 48, the width of gap 60 may vary greatly between pressurizing and retracting strokes as the pressure near pressurizing end 56 varies.

Figure 4:
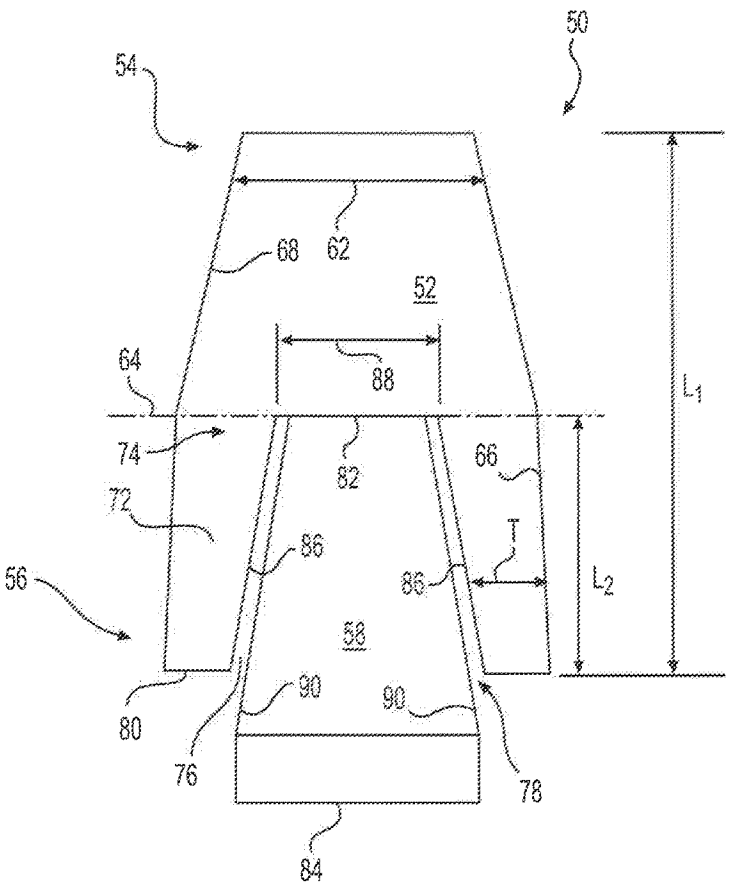
FIGS. 3 and 4 are isometric illustrations of an exemplary disclosed piston that may be used with the pumping mechanism of FIG. 2.

To accommodate the greater fluctuation in the width of gap 60 near pressurizing end 56, body 52 may be configured to flex outwardly and return, thereby expanding and contracting OD profile 62, as the pressure in piston bore 48 increases and decreases, respectively. To achieve this flexibility, as shown in FIG. 4, pressurizing end 56 may include an annular wall 72 attached to body 52 at a fixed end 74. Annular wall 72 may partially define a cavity 76 that has an opening 78 disposed at a free end 80 of annular wall 72 opposite fixed end 74. Head 58 of piston 50 may be disposed in cavity 76 and attached to body 52 at a fixed end 82. Head 58 may extend through cavity 76 to a free end 84, and may occupy a majority of cavity 76.

During pressurizing strokes of pump 10, pressurized fluid may be forced into cavity 76. Pressure in cavity 76 may place an outward force along annular wall 72, thereby expanding OD profile 62 of body 52 and decreasing the clearance within gap 60 (referring to FIG. 2) to decrease leakage past piston 50, During retraction strokes of pump 10, the pressure within cavity 76 may decrease, thereby reducing the outward force on annular wall 72. This reduced force may allow OD profile 62 of body 52 to return to its original size, thereby increasing the clearance in gap 60 and reducing friction between body 52 and piston bore 48.

Annular wall 72 may extend a length $L_2$ from fixed end 74 to free end 80, and partially define cavity 76. Cavity 76 may include a space encompassed by an interior side 86 of annular wall 72 along the length $L_2$ of annular wall 72. Thus, interior wall 86 may partially define an inner diameter (ID) of annular wall 72. $L_2$ may be less than about 75% (e.g., 50%) of the length of $L_1$. In one example, $L_2$ may extend to intermediate point 64. $L_2$ may be longer or shorter, if desired. The ID may vary along a length of annular wall (72) to form an ID profile 88. ID profile 88 may be between about 10% and 90% of OD profile 62. For example, OD profile 62 may be about 32 mm and ID may be about 24 mm at free end 80 of annular wall 72, ID profile 88 may be larger or narrower, if desired.

The length $L_2$ of annular wall 72 may affect the flexibility of body 52. For example, as the length $L_2$ of annular wall 72 increases, fixed end 74 is moved farther from free end 80, and the flexibility of annular wall 72 near pressurizing end 56 of body 52 may increase. Conversely, as the length $L_2$ decreases, the flexibility of annular wall 72 near pressurizing end 56 may decrease. For a given length $L_2$ of annular wall 72, the flexibility of body 52 may decrease from free end 80 toward fixed end 74. That is, for a given outward force along the interior side 86 of annular wall 72, body 52 may flex more near free end 80 of annular wall 72 and flex less near fixed end 74.

Annular wall 72 may have a thickness $\tau$ that may partially affect the flexibility of body 52. For example, as the thickness $\tau$ of annular wall 72 increases, the flexibility of wall 52 may decrease. Conversely, as the thickness $\tau$ of annular wall 72 decreases, the flexibility of wall 52 may increase. In some embodiments, the thickness $\tau$ of annular wall 72 may be generally constant between free end 80 and fixed end 74 of annular wall 72. In other embodiments, the thickness $\tau$ may vary to provide more or less flexibility along annular wall 72. For example, the thickness $\tau$ of annular wall 72 may increase from free end 80 to fixed end 74. In one embodiment, thickness $\tau$ may vary between about 5% and 45% of OD profile 62 from free end 80 to fixed end 74.

In one example, OD profile 62 may be about 32 mm, ID profile 88 may be about 24 mm, and the thickness $\tau$ of annular wall 72 to be about 4 mm near free end 80 of annular wall 72. ID profile 88 may decrease by about 8 mm from free end 80 to fixed end 74, thereby increasing the thickness $\tau$ of annular wall 72 by about 4 mm from free end 80 to fixed end 74. In this way, the flexibility of body 52 may be varied to allow greater expansion of OD profile 62 near free end 80 for accommodating larger variations in gap 60 (referring to FIG. 2) near pressurizing end 56. As ID profile 88 decreases toward fixed end 74, the flexibility of body 52 may decrease to allow less expansion of OD profile 62 for offsetting smaller variations in gap 60.

As shown in FIG. 4, ID profile 88 may vary generally linearly along annular wall 72. For example, annular wall may have a conical profile, and ID profile 88 may vary along one or more straight tapers 90 from free end 80 to fixed end 74. Linear variations, such as that of straight taper 90, may be less complicated and less costly to manufacture than more complicated profiles. In other embodiments, ID profile 88 may vary non-linearly along annular wall 72 to provide more detailed variations in flexibility along body 52 for offsetting more complex variations in the width of gap 60. For example, ID profile 88 may vary along a curved profile of annular wall 72, which may be generally parabolic, exponential, arcuate, logarithmic, etc., or specially curved to achieve a desired change in flexibility or a desired offset of gap 60. It is understood that annular wall 72 may have another type of profile, if desired.

Head 58 may extend from fixed end 82 through cavity 76 to free end 84. In the example shown in FIG. 4, head 58 may extend through opening 78 of cavity 76 beyond free end 80 of annular wall 72. In other embodiments, head 58 may extend a length that is equal to or less than the length $L_2$ of annular wall 72.

Head 58 may occupy a majority of cavity 76 in order to limit the total volume of cavity 76, while ensuring that enough space is available to allow a higher pressure to build within cavity 76 than in gap 60. That is, when the space between interior side 86 and head 58 within cavity 76 is greater than the width of gap 60, cavity 76 is sufficiently large enough to allow pressurized fluid to apply an outward radial force to outwardly expand annular wall 72 in order to reduce the clearance in gap 60. Therefore, to allow higher pressure to build in cavity 76 than in gap 60, the space between interior side 86 and head 58 should be greater than the width of gap 60. The volume of cavity 76 can also add to the total volume of compressed fluid that remains within barrel assembly 34 after a pressurizing stroke and may be minimized. For example, as head 58 occupies more space within cavity 76, the volume of cavity 76 may be reduced, and the total volume of compressed fluid remaining in barrel assembly 34 after a pressurizing stroke may be reduced, thereby improving efficiency of pump 10. For example, head 58 may occupy at least 51-99% of the volume of cavity 76. It is understood, however, that head 58 may occupy less than a majority of cavity 76, if desired.

Head 58 may attach to body 52 by any suitable mechanism, such as by fastening, adhesion, press fitting, welding, material deposition, etc. For example, a fastener, such as a bolt or a screw, may be passed through the center of head 58 and anchored into body 52. In another example, head 58 may have a threaded end or other fastening feature that is received by body 52 to connect head 58 and body 52. In other embodiments, head 58 and body 52 may be a unitary component created during a single forming process, such as by casting, material deposition, machining billet materials, etc.

As shown in FIG. 4, body 52 may include annular wall 72 as well as first and second tapers 66 and 68 on OD profile 62. In this way, body 52 may be configured to more effectively reduce friction and leakage at both pressurizing end 56 and actuating end 54. For example OD may be about 32 mm and ID may be about 24 mm near free end 80 of annular wall 72. ID profile 88 may decrease from about 24 mm to about 16 mm at fixed end 74, thereby allowing body 52 to expand and reduce leakage during pressurizing strokes, and contract to reduce friction during retraction strokes. First taper 66 may reduce OD profile 62 by about 3 microns from pressurizing end 56 to intermediate point 64, and second taper 68 may reduce OD profile 62 by about 5 microns from intermediate point 64 to actuating end 54. In this way, first taper 66 may help achieve the desired clearance along the changing width of gap 60 near pressuring end 56, while second taper 68 may help achieve the desired clearance near actuating end 54.

Reducing friction and leakage past piston 50 by accommodating the variations in gap 60 (referring to FIG. 2) may be further improved by reducing the expansion of body 52 near actuating end 54. Reducing this expansion may be achieved, for example, by reducing the temperature differential between pressurizing end 56 and actuating end 54. By reducing this temperature differential, gap 60 may vary less along the length $L_1$ of body 52 at a wider range of temperatures and pressures, thereby improving the efficiency of pump 10 at a wider range of operating conditions.

Figure 5:
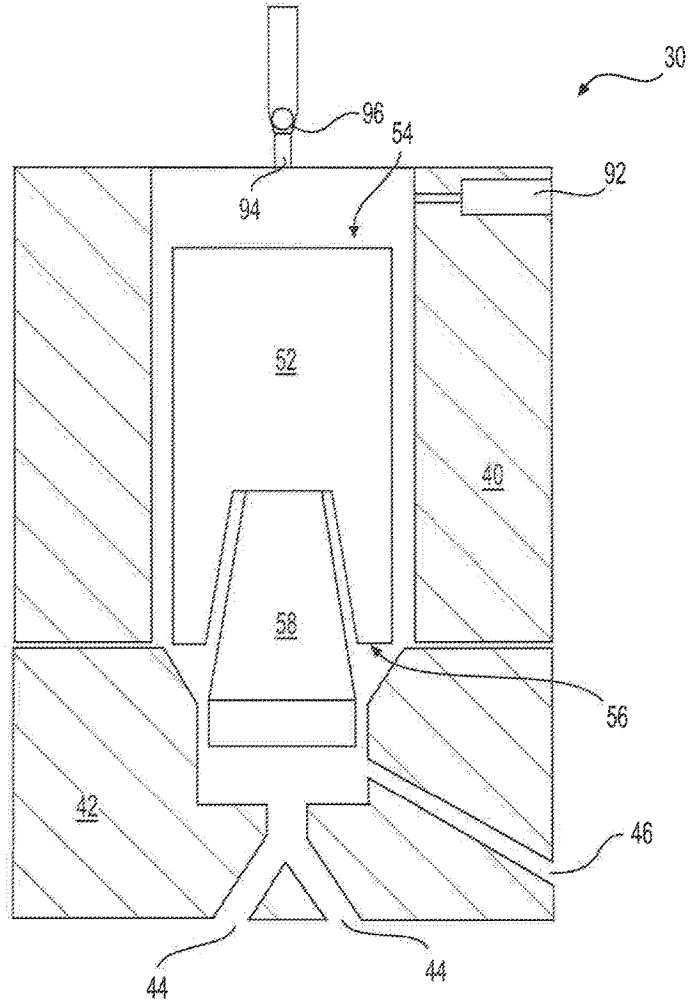
FIG. 5 is another cross sectional illustration of an exemplary disclosed pumping mechanism that may be used with the pump of FIG. 1.

In one example, the temperature differential between pressurizing end 56 and actuating end 54 may be reduced by exposing actuating end 54 to a coolant. As shown in FIG. 5, the coolant may be introduced into piston bore 48 via a coolant inlet 92 that is fluidly connected to barrel 40. Coolant inlet 92 may be positioned near proximal end 36 of barrel assembly 34 and configured to supply a coolant to actuating end of body 52 during and/or after pressurizing strokes. During retraction strokes, piston 50 may force the coolant out of piston bore 48 via a coolant outlet 94 that may be disposed near proximal end 36 of barrel assembly 34, Coolant outlet 94 may be fluidly connected to barrel 40 and configured to remove the coolant from barrel 40 during retraction strokes. Unidirectional flow through outlet 94 may be ensured using a flow control device, such as a check valve 96 (e.g., a ball valve) or other suitable mechanism.

In one embodiment, the coolant may be cryogenic fuel that is diverted from an associated storage tank. The cryogenic fluid expelled through outlet 94 may be returned to the associated storage tank, sent to a fuel consumer, or sent to another storage container. In other embodiments, the coolant may be a different fluid (e.g., air, gaseous or liquid hydrogen, liquid nitrogen, etc.) circulated through a dedicated cooling system or through a pre-existing coolant system of pump 10. It is understood that other coolants may be used.

Expansion of body 52 near actuating end 54 may be alternatively or additionally reduced by forming piston 50 from a material having a low coefficient of thermal expansion (COE). Reducing the COE of piston 50 may reduce overall expansion of body 52 at a wide range of temperatures. The COE of piston 50 may be reduced by forming piston 50 from a material such as a low temperature stainless steel, ceramic, or other material having a low COE. In one embodiment, piston 50 may be formed of the same low-COE material as barrel 40. In other embodiments, piston 50 may be formed of a different material (e.g., a different metal, ceramic, etc) having a lower COE than barrel 40. In this way, body 52 of piston 50 may expand less during operation of pump 10, thereby reducing friction and leakage past piston 50 over a wider range of operating temperatures.

INDUSTRIAL APPLICABILITY

The disclosed piston finds potential application in any fluid pump where maintaining an optimum clearance between a piston and a barrel is desirable for reducing leakage and friction between the piston (and/or its seals) and the barrel. The piston pump finds particular applicability in cryogenic pump applications, for example pumps used in conjunction with power system having engines that burn LNG fuel. One skilled in the art will recognize, however, that the disclosed pump could be utilized in conjunction with other fluid systems that may or may not be associated with a power system, Operation of exemplary pump 10 will now be discussed.

Referring to FIG. 1, driveshaft 18 of pump 10 may rotate load plate 20 as pump 10 is driven. Load plate may depress tappets 21 that drive push rods 22 through pumping mechanisms 30. Each push rod 22 may drive piston 50 (referring to FIG. 2) to reciprocate within piston bore 48. Cryogenic fluid from reservoir 28 may be drawn into piston bore 48 during retraction strokes via inlet 44 of head 42. During pressurizing strokes, piston 50 may pressurize the fluid against head 42, and the pressurized fluid may expelled through outlet 46 to supply a consumer.

During pressurizing strokes, the pressure and temperature within piston bore 48 may cause body 52 of piston 50 and piston bore 48 to expand, thereby increasing or decrease the clearance in gap 60. For example the pressure within piston bore 48 during a pressurizing stroke may cause axial compression and lateral expansion of piston 50. This axial force may cause body 52 to expand radially outward toward piston bore 48, thereby decreasing the clearance within gap 60. Further, the low temperatures of the cryogenic fluid may cause piston 50 and piston bore 48 to contract, but the temperature differential between piston 50 and piston bore 48 may cause body 52 of piston 50 to expand less and further decrease the clearance in gap 60. Actuating end 54 of body 52 may be warmer than actuating end 56 due to leaked fluid that has attained a higher temperature and the heat of friction, which may cause the clearance in gap 60 to be less near actuating end 54 than pressurizing end 56.

However, fluid that has leaked into gap 60 at an initial pressure of $P_1$ may produce radial forces on piston 50 and piston bore 48 that increase the width of gap 60 by expanding piston bore 48 and preventing expansion of body 52 of piston. Due to expansion of the fluids within gap 60 that reduce the pressure of the fluid as it travels from pressurizing end 56 toward actuating end 54, the radial forces may be greatest near pressurizing end 56 and least near actuating end 54. Thus, the net expansion due to pressure and temperature may cause gap 60 to be greatest near pressurizing end 56 and least near actuating end 54.

As piston 50 slides toward distal end 38 of barrel assembly 34, the pressure in piston bore 48 may increase the net expansion near pressurizing end 56 and cause a greater clearance in gap 60. First taper 66 (referring to FIGS. 3 and 5) may reduce leakage caused by this expansion by reducing the clearance near pressurizing end 56. First taper 66 may also reduce friction by reducing OD profile 62 from pressurizing end 56 toward intermediate point 64. Second taper 68 may further reduce OD profile 62 from intermediate point 64 to actuating end 54, thereby increasing the clearance near actuating end 54 and reducing friction. In this way, the clearance in gap 60 may be more consistent and effectively reduce leakage and friction simultaneously.

The increased pressure during pressurizing strokes may also force pressurized fluid through opening 78 of cavity 76 (referring to FIG. 4) of pressurizing end 56. As pressure in piston bore 48 increases, pressure in cavity 76 may increase and generate radial forces that cause annular wall 72 to expand radially outward toward piston bore 48. The expansion of annular wall 72 may expand OD profile 62 to further reduce the clearance in gap 60 near pressurizing end 56 and further reduce leakage during pressurizing strokes.

After each pressurizing stroke, piston 50 may retract within piston bore 48 toward proximal end 36 of barrel assembly 40 (referring to FIG. 2). As piston 50 retracts, the pressure within piston bore 48 may decrease, thereby decreasing the radial forces on annular wall 72, which may cause annular wall 72 and OD profile 62 to return to their original dimensions and increase the clearance in gap 60. This increase of clearance may allow friction to be reduced between body 52 and piston bore 48 during retraction strokes. The combination of the flexibility of annular wall 72 and tapers 66 and 68 may cooperatively reduce friction and leakage past piston 50 during pressurizing and retraction strokes, thereby improving the overall efficiency of pump 10.

During each pressurizing stroke, a coolant may be introduced through coolant inlet 92 into piston bore 48 near actuating end 54 of piston 50. The coolant may reduce the temperature of actuating end 54, thereby bringing its temperature closer to the temperature of pressurizing end 56 and piston bore 48. By bringing these temperatures closer together, the difference in expansion between piston 50 and piston bore 48 may be reduced, thereby reducing the variations in the clearance of gap 60. As gap 60 is allowed to be more consistent along body 52, friction and leakage past piston 50 may be reduced. The coolant may then be expelled through coolant outlet 94 during the following retraction stroke.

As discussed, the disclosed piston 50 may reduce leakage of fuel through gap 60 between piston 50 and piston bore 48 while also reducing friction between piston 50 and piston bore 48 to improve the overall efficiency of pump 10. Particularly, piston 50 may include body 52 that has OD profile 62 that varies along the length $L_1$ of body 52 to reduce leakage and friction caused by variations in gap 60. Further, body 52 of piston 50 may include ID profile 88 that allows OD profile 62 to expand and contract with pressure in barrel 40 to achieve a smaller clearance in gap 60 during pumping strokes to prevent fuel leakage. ID profile 88 further allows OD profile 62 to achieve a greater clearance during retraction strokes to reduce friction and improve efficiency.

It will be apparent to those skilled in the art that various modifications and variations can be made to the pump piston of the present disclosure. Other embodiments of the pump piston will be apparent to those skilled in the art from consideration of the specification and practice of the pump piston disclosed herein. It is intended that the specification and examples be considered as exemplary only, with a true scope being indicated by the following claims and their equivalents.

What is claimed is:

1. A pump piston, comprising:
a body including:
an actuating end;
a pressurizing end opposite the actuating end; and
an outer diameter that is greater at the pressurizing end than at the actuating end, wherein the outer diameter varies from the pressurizing end, of the body to the actuating end of the body without increasing to form an outer diameter profile, wherein the outer diameter profile tapers at a first rate continuously from the pressurizing end to an intermediate point of the body, and at a second greater rate continuously from the intermediate point to the actuating end.

2. The pump piston of claim 1, wherein the outer diameter profile is at least partially curved along an axial length of the body.

3. The pump piston of claim 1, further including an annular wall located at the pressurizing end the annular wall having a fixed end attached to the body and a free end opposite the fixed end.

4. The pump piston of claim 3, wherein the inner diameter of the body varies along the annular wall.

5. The pump piston of claim 4, wherein the inner diameter of the body decreases from the fixed end toward the free end.

6. The pump piston of claim 5, wherein the annular wall has a thickness that increases from the free end to the fixed end.

7. A pump piston, comprising:
a body, the body including:
an actuating end; and
a pressurizing end opposite the actuating end, the pressurizing end including:
an annular wall having a fixed end attached to the body, and a free end opposite the fixed end, the annular wall having an interior side extending from the fixed end to the free end, the annular wall defining a cavity having an opening disposed at the free end of the annular wall; and
a head attached to the body and disposed within the cavity, the head being spaced apart from the interior side of the annular wall defining a space between the head and the interior side of the annular wall, wherein the head occupies a majority of the cavity.

8. The pump piston of claim 7, wherein the annular wall includes an inner diameter that varies along a length of the annular wall to form an inner diameter profile.

9. The pump piston of claim 8, wherein the inner diameter decreases from the free end to the fixed end.

10. The pump piston of claim 9, wherein the annular wall has a thickness that increases from the free end to the fixed end.

11. The pump piston of claim 10, wherein the length of the annular wall is less than 75% of an axial length of the body.

12. The pump piston of claim 8, wherein the body further includes an outer diameter that is greater at the pressurizing end than at the actuating end.

13. The pump piston of claim 12, wherein the outer diameter varies between the pressurizing end and the actuating end without increasing to form an outer diameter profile.

14. The pump piston of claim 13, wherein the outer diameter profile is at least partially tapered between the pressurizing end and the actuating end.

15. The pump piston of claim 14, wherein the outer diameter profile tapers at a first rate between the pressurizing end and an intermediate point, and at a second greater rate between the intermediate point and the actuating end.

16. The pump piston of claim 13, wherein the outer diameter profile at is at least partially curved between the pressurizing end and the actuating.

17. A pumping mechanism, comprising:
a barrel fluidly connected to a source of cryogenic fluid; and
a piston configured to be reciprocally driven within the barrel to pressurize the cryogenic fluid, wherein the piston includes:
a body, the body including:
an actuating end;
a pressurizing end opposite the actuating end, the pressurizing end including an annular wall, the annular wall having a fixed end attached to the body, and a free end opposite the fixed end; and
an outer diameter that varies along an axial length of the body from the pressurizing end to the actuating end without increasing forming an outer diameter profile, wherein the outer diameter profile is greater at the pressurizing end than at the actuating end, and wherein the outer diameter profile tapers at a first rate continuously from the pressurizing end to an intermediate point of the body, and at a second greater rate continuously from the intermediate point to the actuating end.

18. The pumping mechanism of claim 17, further including:

a coolant inlet fluidly connected to the barrel and configured to supply a coolant to the actuating end of the piston; and a coolant outlet fluidly connected to the barrel and configured to remove the coolant from the barrel.

* * * * *